US006144163A

United States Patent [19]

Amemiya et al.

[11] Patent Number: 6,144,163

[45] Date of Patent: Nov. 7, 2000

[54] METHOD OF DRIVING PLASMA DISPLAY DEVICE

[75] Inventors: Kimio Amemiya; Hiroyuki Ajiki, both of Yamanashi, Japan

[73] Assignee: Pioneer Corporation, Tokyo, Japan

[21] Appl. No.: 09/343,274

[22] Filed: Jun. 30, 1999

[30] Foreign Application Priority Data

Jul. 29, 1998 [JP] Japan ..... 10-214491

[51] Int. Cl.[7] ..... G09G 3/10

[52] U.S. Cl. ..... 315/169.1; 345/55; 345/60; 345/68

[58] Field of Search ..... 315/169.1, 169.2, 315/169.3, 169.4; 345/55, 60, 67, 68; 445/24; 313/582, 583, 584, 585, 586, 587

[56] References Cited

U.S. PATENT DOCUMENTS 4,554,537 11/1985 Dick ..... 340/775
4,684,849 8/1987 Otsuka et al. ..... 315/169.3
5,854,540 12/1998 Matsumoto et al. ..... 315/169.1
5,903,381 5/1999 Watanabe et al. ..... 359/254
5,963,184 10/1999 Tokunaga et al. ..... 345/60
5,998,935 12/1999 Marcotte ..... 315/169.4
6,020,687 2/2000 Hirakawa et al. ..... 315/169.1

*Primary Examiner*—Don Wong
*Assistant Examiner*—Thuy Vinh Tran
*Attorney, Agent, or Firm*—Sughrue, Mion, Zinn, Macpeak & Seas, PLLC

[57] ABSTRACT

A method of driving a plasma display device for producing a display by using an addressing period in which paired row electrodes are applied with a scan pulse, and column electrodes are simultaneously applied with pixel data pulses to select light emitting pixels and non-light emitting pixels, and a discharge sustaining period in which the paired row electrodes are applied with a sustain pulse to sustain discharges for light emitting pixels and non-light emitting pixels, wherein the sustain pulse has a waveform exhibiting a change in magnitude of a voltage value which gently increases from the vicinity of a minimal discharge sustaining voltage value in a unit light emitting region.

6 Claims, 11 Drawing Sheets

$\Delta V1 > \Delta V2 > \Delta V3 > \Delta V4 > \fallingdotseq 0$ $V1' < V2' < V3' \fallingdotseq V4'$ $\Delta V1' \fallingdotseq \Delta V2' \fallingdotseq \Delta V3' > \Delta 4'$

METHOD OF DRIVING PLASMA DISPLAY DEVICE

BACKGROUND OF THE INVENTION

1. Field of the Invention

The present invention relates to a method of driving a plasma display device.

2. Description of the Related Art

A plasma display device has been implemented as one type of thin two-dimensional screen display device. A matrix-type surface discharge AC plasma display panel having a memory function is known as one of plasma display devices.

FIG. 1 illustrates one of a plurality of pixel cells constituting a surface discharge AC plasma display panel 120 of an embodiment which employs a three-electrode structure. In this type of plasma display panel, two substrates, i.e., a front glass substrate 122 and a back glass substrate 124, are positioned opposite to each other with a predetermined gap intervening therebetween. On an inner surface (i.e., a surface opposite to the back glass substrate) of the front glass substrate 122 serving as a display plane displaying an image, a plurality of paired row electrodes Xi, Yi (i=1,2, . . . ,n) extending in parallel, are formed as paired sustain electrodes. Each of the row electrodes Xi, Yi is composed of a transparent electrode and a metal bus electrode $\alpha i$ or $\beta i$. A dielectric layer 130 is formed in a predetermined thickness so as to overlay these row electrodes Xi, Yi, and an MgO layer 132 is formed in a predetermined thickness directly on the dielectric layer 130.

On the back glass substrate 124, on the other hand, a plurality of barrier ribs 126 are formed in parallel with and adjacent to each other in order to support the front substrate 122 and define a discharge space 128. Between the front substrate 122 and the back glass substrates 124, a plurality of column electrodes Dj (j=1,2, . . . , m), intersecting with the paired row electrodes Xi, Yi, are formed to extend as address electrodes, and a fluorescent material 136 is coated overlaying the column electrodes Dj.

The front substrate 122 and the back substrate 124 are air-tight sealed, the discharge space 128 is evacuated, and moisture is removed from the surface of the MgO layer 132 by baking. Then, a discharge gas including Xenon (Xe) is hermetically sealed in the discharge space 128. When viewed from the display plane, cells, i.e., unit light emitting regions each corresponding to a pixel or a light emitting cell are formed in a matrix form, each centered on the intersection of the paired row electrodes Xi, Yi and a column electrode Dj. In one cell, a gap between the row electrodes or the transparent electrodes near the intersection functions as a discharge gap. The row electrodes and the column electrodes may be referred to as "discharge electrodes."

FIG. 2 illustrates the configuration of a driver for driving a plasma display panel 120 which comprises column electrodes D1 to Dm connected to a pixel data pulse generator circuit 212, and paired row electrodes X1, Y1 to Xn, Yn connected to a row electrode driving pulse generator circuit 210.

Referring specifically to FIG. 2, a synchronization separating circuit 201 extracts horizontal and vertical synchronization signals from an input video signal supplied thereto, and supplies a timing pulse generator circuit 202 with the extracted synchronization signals. The timing pulse generator circuit 202 generates an extracted synchronization signal timing pulse based on the extracted horizontal and vertical synchronization signals, and supplies this timing pulse to an A/D converter 203, a memory control circuit 205 and a read timing signal generator circuit 207, respectively. The A/D converter 203 converts the input video signal to digital pixel data corresponding to each pixel in synchronism with the extracted synchronization signal timing pulse, and supplies the digital pixel data to a frame memory 204. The memory control circuit 205 supplies the frame memory 204 with a read signal and a write signal in synchronism with the extracted synchronization signal timing pulse. The frame memory 204 sequentially fetches respective pixel data supplied from the A/D converter 203 in response to the write signal. Pixel data stored in the frame memory 204 is sequentially read therefrom in response to the read signal and supplied to an output processing circuit 206 at the next stage. The read timing signal generator circuit 207 generates a variety of timing signals for controlling a discharge light emission operation, and supplies these timing signals to the row electrode driving pulse generator circuit 210 and to the output processing circuit 206. The output processing circuit 206 supplies the pixel data pulse generator circuit 212 with pixel data supplied from the frame memory 204 in synchronism with a timing signal from the read timing signal generator circuit 207.

The pixel data pulse generator circuit 212 generates a pixel data pulse DP corresponding to each of pixel data supplied from the output processing circuit 206, and applies the pixel data pulse DP to the column electrodes D1–Dm of the plasma display panel 120.

The row electrode driving pulse generator circuit 210 generates first and second predischarge pulses for performing a predischarge between all pairs of row electrodes X1, Y1 to Xn, Yn in the plasma display panel 120, a priming pulse for re-forming charged particles, a scan pulse for writing pixel data, a sustain pulse for sustaining a discharge for emitting light in accordance with pixel data, and an erasure pulse for stopping the discharge sustained for light emission. The row electrode driving pulse generator circuit 210 supplies to the row electrodes X1–Xn and Y1–Yn of the plasma display panel 120 with these pulses at timings corresponding to a various types of timing signals supplied from the read timing signal generator circuit 207.

The row electrode driving pulse generator circuit 210 includes an X-driver for generating a sustain pulse for the row electrodes X1 to Xn, and a Y-driver for generating a sustain pulse for the row electrodes Y1 to Yn.

For driving a surface discharge AC plasma display panel having a plurality of pixel cells formed in matrix, it is necessary to select whether or not each pixel cell is to emit light in each sub-frame. In this event, for providing a uniform difference in light emitting condition between pixel cells due to the difference in data for images to be displayed in each sub-frame, and also for stabilizing a discharge when writing data, a rectangular reset pulse is applied between row electrodes of the paired row electrodes to initialize all cells by the action of a reset discharge caused by the application of reset pulse. Next, a rectangular scan pulse is applied to the column electrodes selected in accordance with data to cause selective discharges between the selected column electrodes and associated row electrodes to write data into corresponding pixel cells.

In the initialization of and the data write into pixel cells, there are two possible processes. First, selective writing is performed for selecting pixel cells, from which light is to be emitted, by previously generating a constant amount of wall charges in all pixel cells by the reset discharge and increasing the wall charges in the pixel cells by a so-called selective discharge using a scan pulse applied to selected column electrodes. Second, a selective erasure is performed for selecting pixel cells to be maintained unlit by extinguishing wall charges in the pixel cells by a selective discharge. Subsequently, a sustain pulse is applied to produce a sustaining discharge for maintaining emitted light in selected pixel cells during the selective write or to produce a sustaining discharge for maintaining emitted light in non-selected pixel cells during the selective erasure. Further, after a predetermined time has elapsed, data written in pixel cells is erased by applying erasure pulses to the pixel cells in any data write.

OBJECT AND SUMMARY OF THE INVENTION

A color surface discharge AC plasma display panel uses a discharge gas for providing visible light by irradiating a fluorescent material with vacuum ultraviolet light (hereinafter designated "VUV") from Xe, produced by a discharge. The discharge gas may include, in addition to Xe, a buffer gas such as He, Ne or the like for the purpose of reducing a discharge voltage or the like. Typically, the discharge gas is hermetically sealed at a total pressure of approximately several hundred Torr order.

Generally, a rectangular pulse is used as the sustain pulse generated by the row electrode driving pulse generator circuit 210. FIG. 3A illustrates a rectangular pulse used in a conventional driving method. Actually, the rectangular pulse has a rising time "tr" of typically several hundred nanoseconds (ns) when a voltage of several hundred volts is applied. With the rectangular waveform as illustrated, the output waveform of VUV exhibits its peak luminance at the time the rectangular pulse reaches a constant voltage or in the middle of the rising voltage waveform, and subsequently goes attenuating as illustrated in FIG. 3B. A sustain voltage is selected to be more or less an average voltage of a discharge start voltage "Vf" and a minimal discharge sustaining voltage "Vsm" (hereinafter designated "Vave") for maintaining a stable discharge. The minimal discharge sustaining voltage "Vsm" refers to a voltage of a minimum value applied to the discharge space for causing a discharge to occur.

On the other hand, a buffer gas exhibits an excitation voltage and an ionization voltage higher than those of Xe. For example, the ionization voltage is 12.1 eV for Xe; 24.6 eV for He; 21.6 eV for Ne; 15.8 eV for Ar; and 14.0 eV for Kr. For example, as illustrated in FIG. 4, the ionization coefficient ($\alpha i/N$) of Xe rises at a lower electric field strength (E/N), i.e., a lower voltage than that of He. The same applies to the excitation coefficient. It is therefore desirable to produce a discharge at the lowest possible voltage in order to generate VUV using Xe. This is because, as illustrated in FIG. 5, the ratio of VUV energy to a power applied to a discharge gas mixture composed of Xe and Ne, i.e., a VUV generating efficiency ($R_{ex147}\epsilon_{ex147}/VdE$) is higher at a lower electric field strength (E/N).

However, with a driving method using the rectangular sustain pulse having a sustain voltage "Vave" as illustrated in FIG. 3A, an electric field strength generated in a cell by the sustain pulse is too enough to cause fairy excitation and ionization of a buffer gas as well as excitation of Xe, thus increasing useless power consumption. This is because, as illustrated in FIG. 6, the distribution of a potential between dielectric layers 130 generated by wall charges formed on the associated dielectric layers 130 from row electrodes Xi, Yi in a cell of a surface discharge AC plasma display panel changes from a potential distribution exhibiting an abrupt gradient to a potential distribution exhibiting a gentle gradient over time from rising to falling in the order of periods I, II, III and IV corresponding to time section shown in FIG. 3. More specifically, assuming that potential differences generated between the wall charges over row electrodes Xi, Yi during the periods I, II, III and IV shown in FIGS. 3 and 6 are $\Delta V1$, $\Delta V2$, $\Delta V3$ and $\Delta V4$ respectively, $\Delta V1>\Delta V2>\Delta V3>\Delta V4>\approx 0$ is satisfied. In this case there is a rapid decreasing of potential difference between the wall charges over row electrodes Xi, Yi. Thus a rectangular sustain pulse causes a discharge current to sufficiently flow during its rising period I and sustain start period II, as previously illustrated in FIGS. 3 and 6, thus resulting in occurrence of a higher electric field strength to increase the invalid power consumption.

If the sustain voltage of the rectangular sustain pulse externally applied to cells is set at a lower voltage near the minimal discharge sustaining voltage "Vsm", a discharge, even if starting once, will become weaker due to the wall charges generated as a feature of the surface discharge AC plasma display panel, thereby resulting in a reduced luminance produced thereby. Alternatively, if the number of sustain pulses is increased with the intention of providing a higher luminance, a reactive power will also increase, thereby failing to significantly improve a light emitting efficiency.

The present invention has therefore been made to solve the problem mentioned above, and its object is to provide a method of driving a plasma display device which is capable of achieving a stable micro-discharge at a lower voltage to improve the light emitting efficiency.

A method of driving a plasma display device according to the present invention is directed to a plasma display device which comprises a plurality of row electrodes formed in pairs and extending in parallel with each other in the horizontal direction, a plurality of column electrodes opposing the paired row electrodes with a discharge space intervening therebetween and extending in the vertical direction to form unit light emitting regions at respective intersections with the paired row electrodes, and a dielectric layer for overlaying the paired row electrodes with respect to the discharge space. The discharge space is filled with a gas mixture including Xenon at a predetermined pressure. The plasma display device performs a display operation by using an addressing period in which the paired row electrodes are applied with a scan pulse, and the column electrodes are simultaneously applied with pixel data pulses to select light emitting pixels and non-light emitting pixels, and a discharge sustaining period in which the paired row electrodes are applied with a sustain pulse to sustain discharges for the light emitting pixels and the non-light emitting pixels. The sustain pulse has a waveform exhibiting a change in magnitude of a voltage value which gently or gradually increases from the vicinity of a minimal discharge sustaining voltage value in the unit light emitting region.

In a method of driving a plasma display device in an aspect of the invention, an change rate of the voltage value gently increasing from the vicinity of a minimal discharge sustaining voltage value in said unit light emitting region is 50 volts or less per microsecond.

In a method of driving a plasma display device in another aspect of the invention, said change in the voltage value of said sustain pulse is gentle as compared with a change in a voltage value rising or falling at a leading edge of said scan pulse.

In a method of driving a plasma display device in another aspect of the invention, said method executes, during generation of each of said sustain pulses, a first process for starting a discharge with a voltage in the discharge space set at an initial voltage far a minimal discharge sustaining voltage; and a second process for gradually increasing an externally applied voltage for preventing an electric field in the discharge space from decreasing due to wall charges possibly formed after the discharge has been started.

In a method of driving a plasma display device in another aspect of the invention, said initial voltage is set within a following range:

$$Vsm-1.0\times(Vf-Vsm)\leqq V0\leqq Vsm+0.2\times(Vf-Vsm)$$

where "Vsm" represents the minimal discharge sustaining voltage in a normal rectangular pulse, and "Vf" represents a discharge start voltage.

In a method of driving a plasma display device in another aspect of the invention, said the sustain pulse which exhibits gradually rising is selected from a group composed of pulse waveforms having a saw-tooth wave, a triangular wave and a sinusoidal wave.

According to the present invention, since an externally applied voltage is gradually increased to sustain a discharge near the minimal discharge sustaining voltage, the VUV generating efficiency is improved. In addition, since a discharge can be sustained for a long time while maintaining the discharge space at a low voltage, the luminance will not be reduced. As a result, it is possible to achieve a practically high luminance over all cells on the entire surface of the panel of a plasma display device, and accordingly increase the light emitting efficiency.

BRIEF DESCRIPTION OF THE DRAWINGS

The aforementioned aspects and other features of the invention are explained in the following description, taken in connection with the accompanying drawing figures wherein.

DESCRIPTION OF THE PREFERRED EMBODIMENTS

The preferred embodiments of a plasma display device and a method for driving the same according to the invention are described in detail referring to the accompanying drawings.

Figure 1:
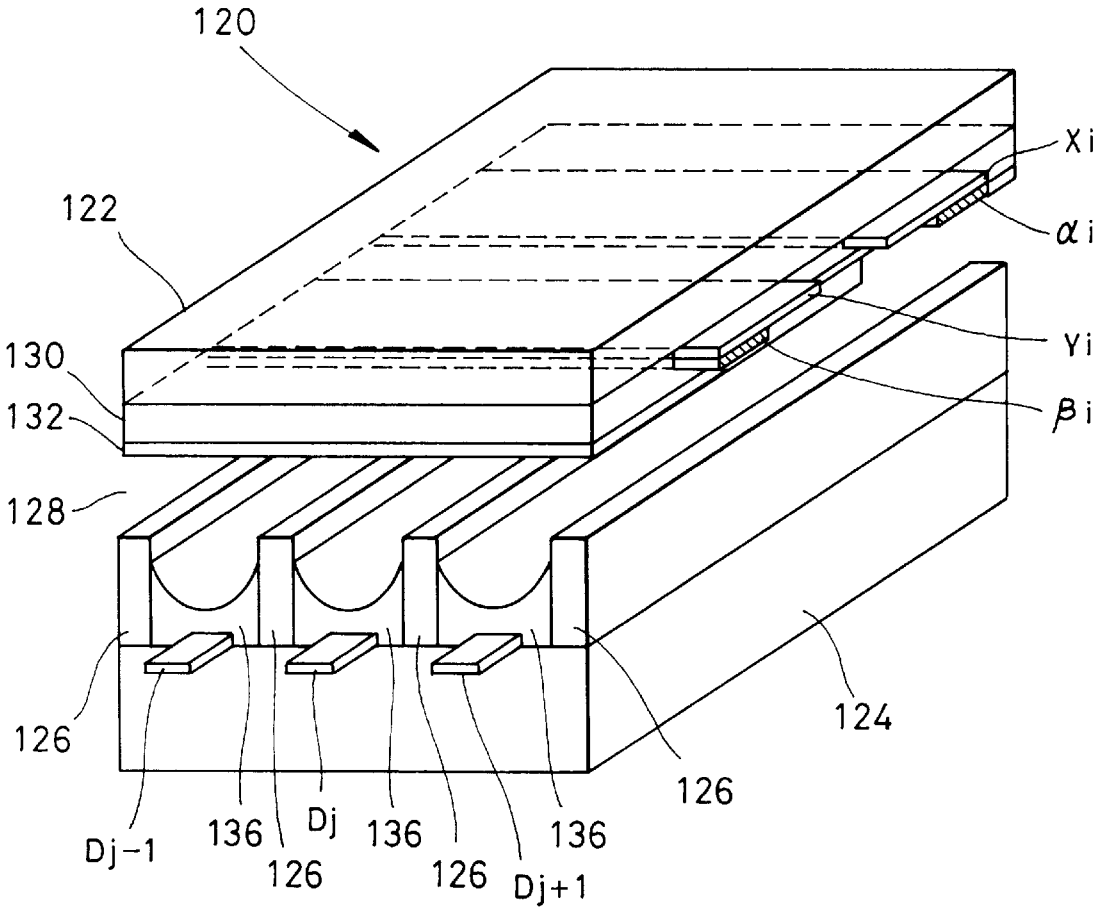
FIG. 1 is a perspective view schematically illustrating a pixel cell in a surface discharge AC plasma display device.
Figure 2:
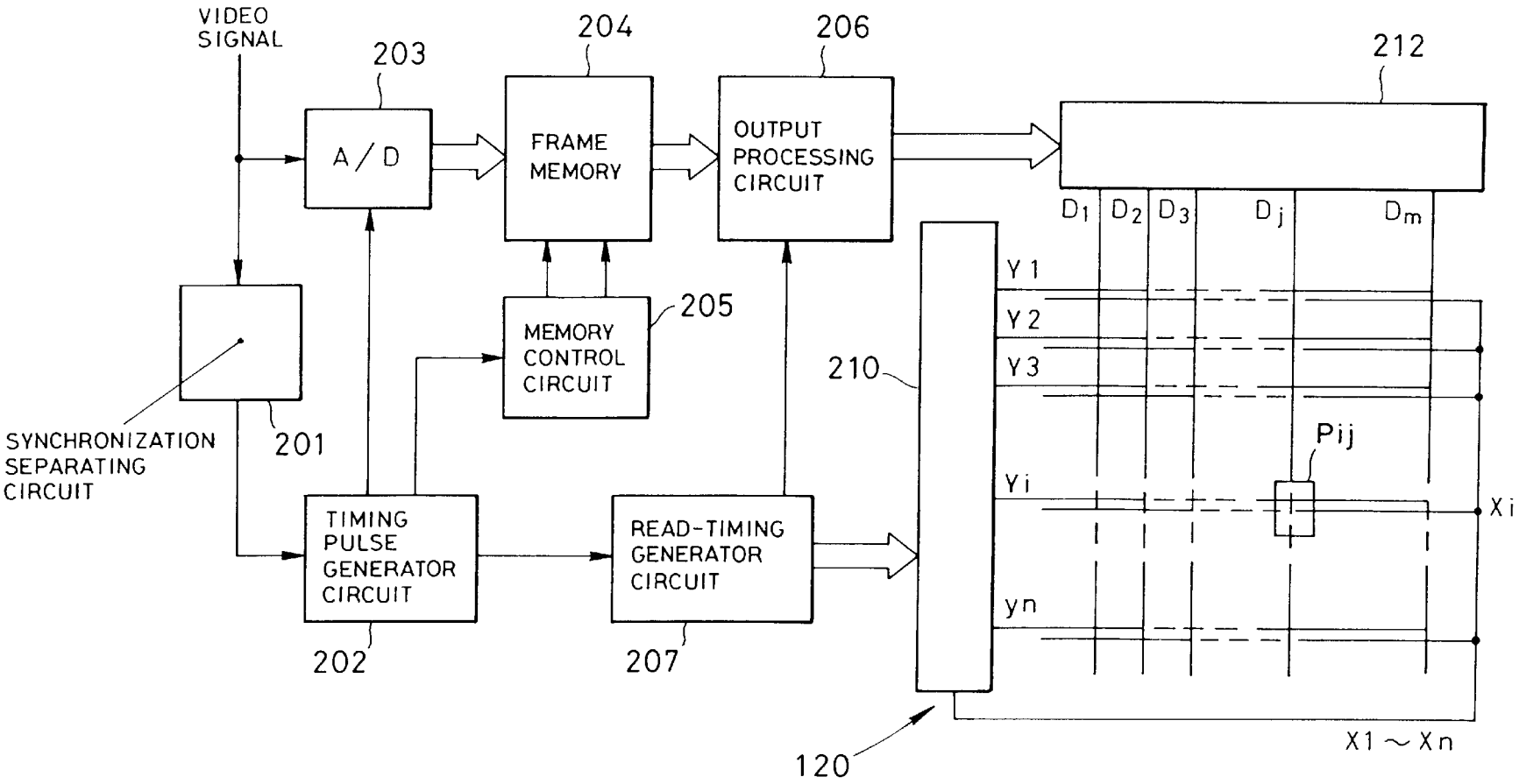
FIG. 2 is a block diagram illustrating a driver for use in a surface discharge AC plasma display device.
Figure 3A:
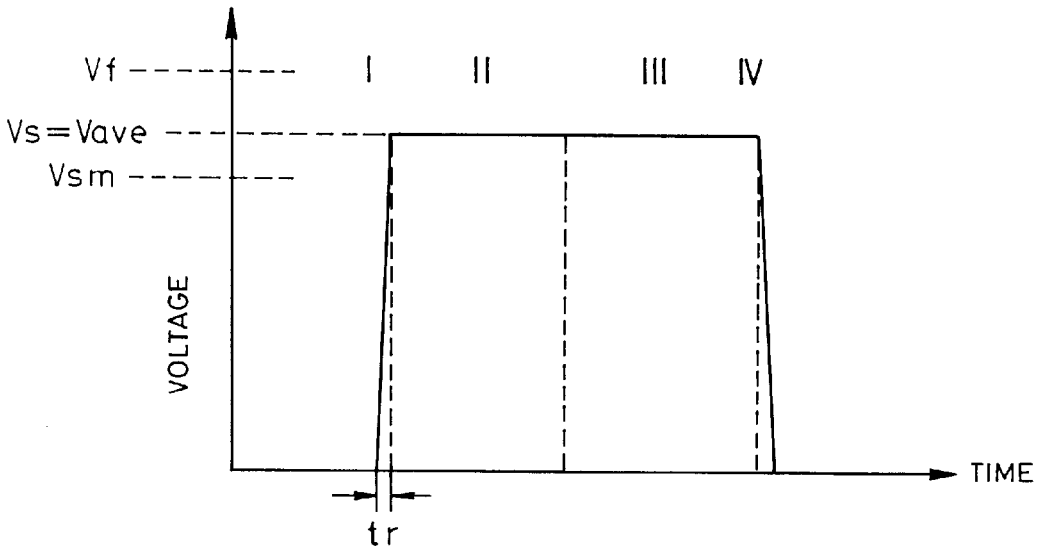
FIGS. 3A and 3B are diagrams illustrating a charging voltage waveform of a sustain pulse applied to row electrodes and a corresponding change in the luminance of light emitted from a cell in a conventional method of driving a plasma display device, respectively.
Figure 3B:
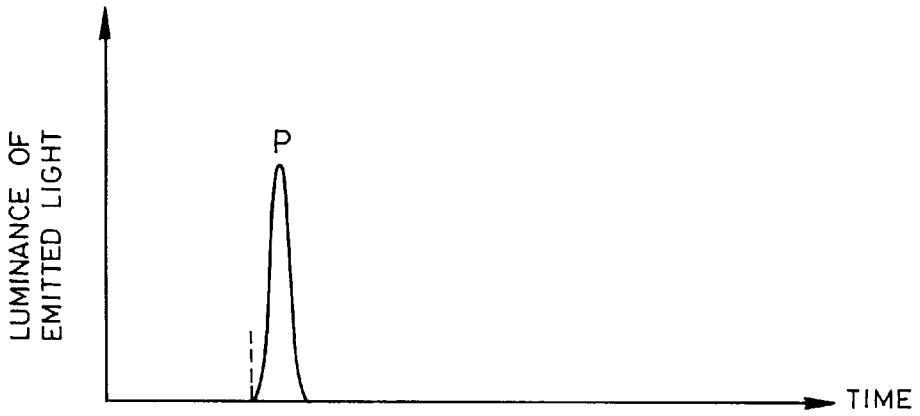
Figure 4:
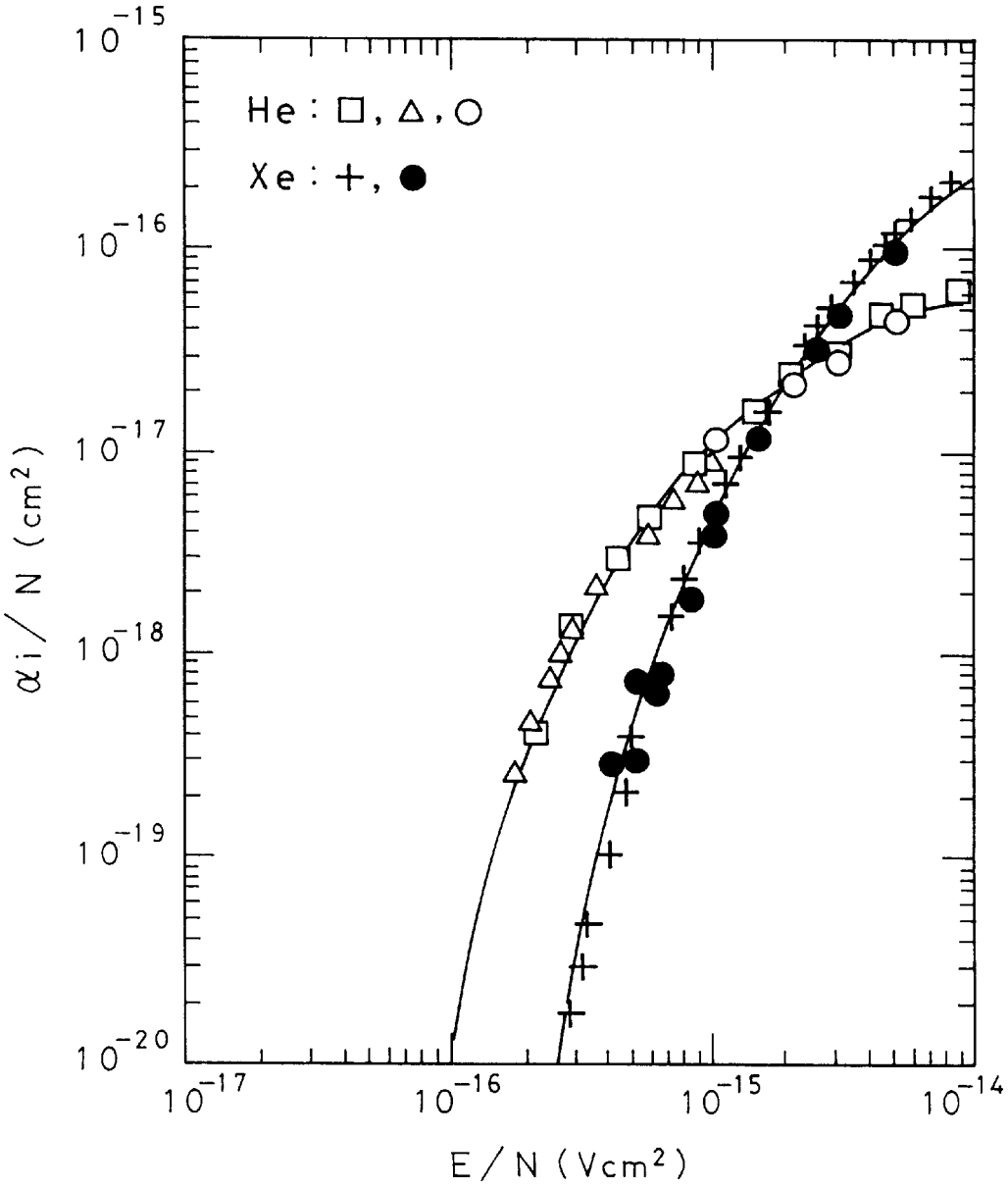
FIG. 4 is a graph illustrating the relationship between the ionization coefficient ($\alpha i/N$) and an electric field strength (E/N) for Xe and He.
Figure 5:
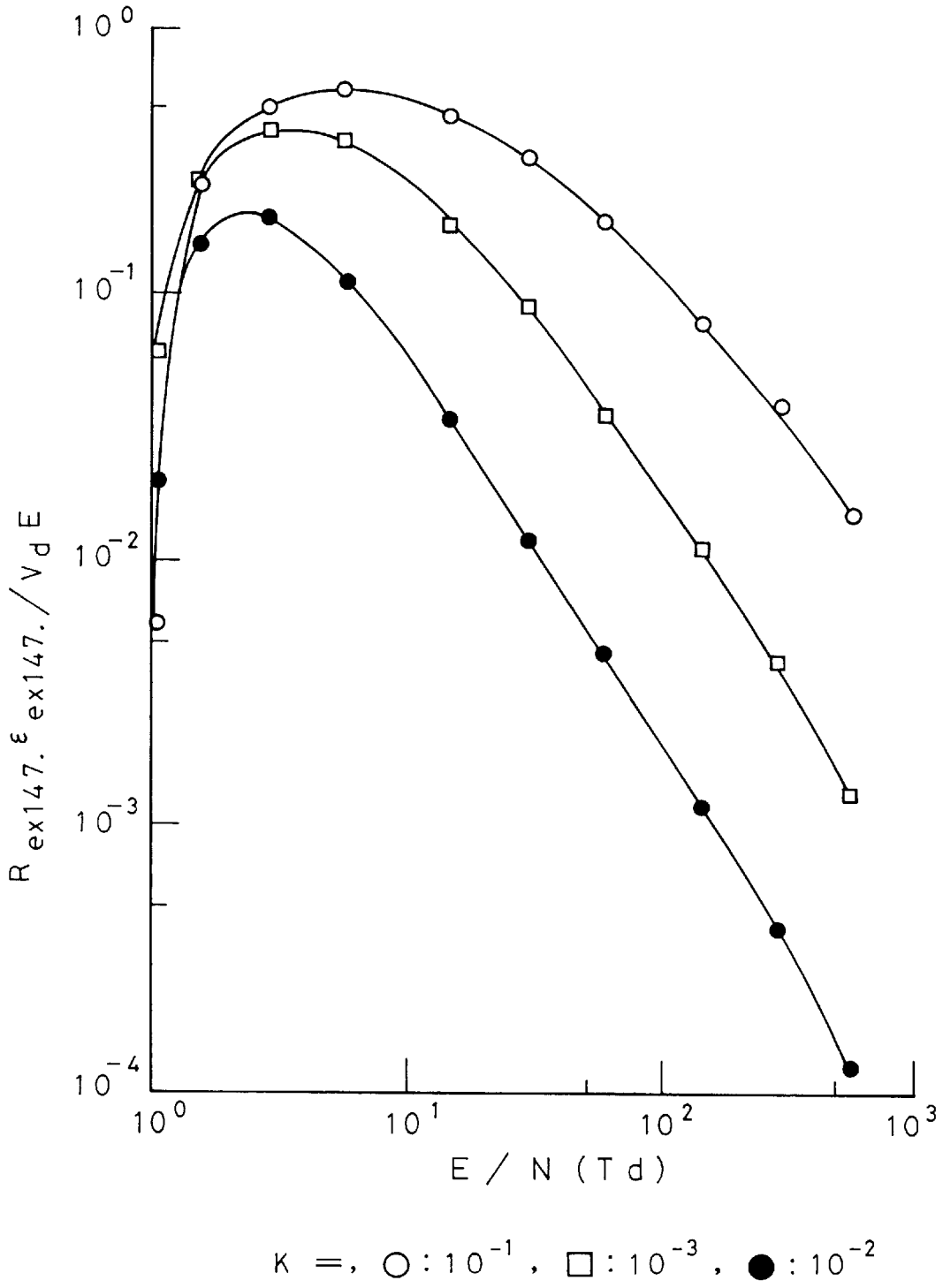
FIG. 5 is a graph illustrating the relationship between a VUV generating efficiency and an electric field strength (E/N) in a discharge gas mixture composed of Xe and He.
Figure 6:
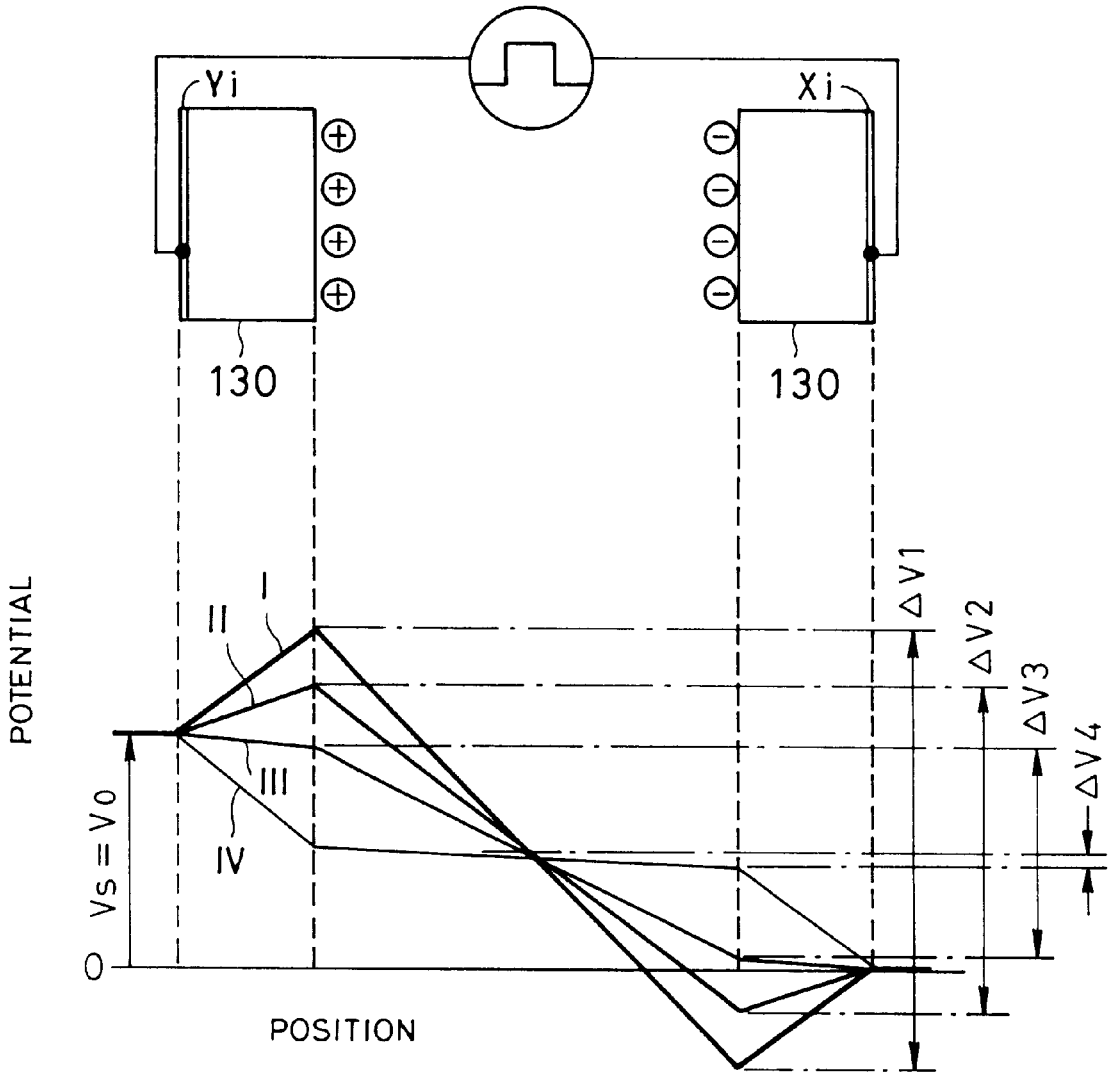
FIG. 6 is a graph illustrating a potential distribution between dielectric layers produced by wall charges formed on the dielectric layers in a cell of a plasma display panel when a conventional rectangular sustain pulse is applied.

A plasma display device of an embodiment has a similar construction to that shown in FIGS. 1 and 2 except the row electrode driving pulse generator circuit 210 which preforms method of driving the plasma display panel 120.

Next, the method of driving the plasma display panel 120 constructed as illustrated in FIG. 1 will be described with reference to FIG. 11.

Figure 11:
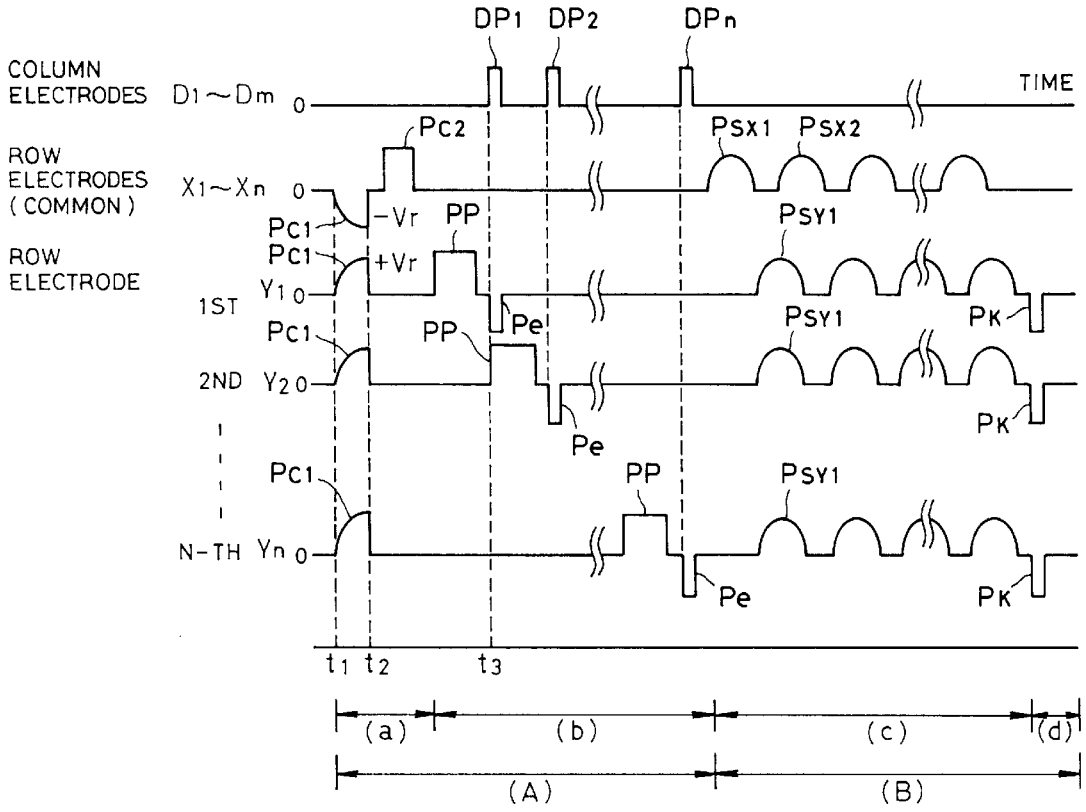
FIG. 11 is a timing chart showing timings at which pulses are applied to a plasma display panel in an embodiment of a method of driving a surface discharge AC plasma display device according to the present invention.

FIG. 11 illustrates timings at which a variety of pulses are applied to the plasma display panel 120 when it is driven.

Making a particular reference to one pixel cell Pi,j ($1\leqq i\leqq n$, $1\leqq j\leqq m$), the pixel cell Pi,j provides a dynamic display operation by repeating a sub-field which comprises a non-display period (A) including a pixel cell initialization period (a) and a next data write period (b), and a display period (B) including a discharge sustaining period (c) and a data erasure period (d).

In the period (a), wherein no pixel data is supplied to the pixel cell Pi,j, the row electrode driving pulse generator circuit 210 simultaneously supplies all row electrodes Xi, Yi of all row electrode pairs with a reset pulse Pc1 as a first predischarge pulse at time $t_1$. In this event, in each of the paired row electrodes Xi, Yi, one electrode Xi in the pair is supplied, for example, with a negative-polarity pulse having such a waveform that gradually falls from a leading edge and reaches a potential −Vr at a trailing edge, as a first sub-pulse, while the other electrode Yi is applied, for example, with a positive-polarity pulse, opposite to the first sub-pulse, having such a waveform that gradually rises from the leading edge and reaches a potential +Vr at the trailing edge as a second sub-pulse. As can be seen, the first predischarge pulse ha a waveform which gradually falls. An associated cell starts discharging when a potential difference generated between paired row electrodes by these pulses exceeds the minimal discharge start voltage. This reset discharge, i.e., a predischarge, instantaneously terminates such that wall charges generated by the reset discharge substantially uniformly remain on the dielectric layer in all the pixel cells.

However, since the pulse gently or gradually falls at the leading edge, the magnitude of the predischarge produced by the first predischarge pulse Pc1 is smaller. The predischarge with a smaller magnitude is more likely to cause a reduced amount of generated wall charges in each pixel cell and a larger difference in the amount of generated wall charges in respective pixel cells over the entire panel.

To solve this problem, i.e., to generate a uniform amount of wall charges in respective pixel cells over the entire plasma display panel, the row electrode driving purse generator circuit 210 supplies one of the paired row electrodes, for example, the row electrodes Xi with a second predischarge pulse Pc2 having the polarity opposite to that of the first sub-pulse at time $t_2$ immediately after the first predischarge pulse has been applied in the period (a), to cause another predischarge to correct non-uniformity in the amount of wall charges generated in the respective pixel cells, thus enabling a uniform amount of wall charges to be generated in the respective pixel cells over the entire plasma display panel.

Next, in the period (b), a pixel data pulse generator circuit 212 sequentially applies the column electrodes D1–Dm with pixel data pulses DP1–DPn having positive voltages corresponding to pixel data of respective rows. The row electrode driving pulse generator circuit 210, in turn, supplies the row electrodes Y1–Yn with a scan pulse having a small pulse width, i.e., a data selection pulse Pe in synchronism with each application timing of the pixel data pulses DP1–DPn. In this event, immediately before supplying the respective row electrodes Yi with the scan pulse Pe, the row electrode driving pulse generator circuit 210 supplies one row electrode Yi, paired with the other row electrode Xi, with a priming pulse PP having the polarity opposite to that of the first sub-pulse Pc1, for example, the positive polarity. For example, a pixel cell P1,j is supplied with a data pulse corresponding to associated pixel data at time $t_3$ to determine whether or not the pixel cell P1,j emits light.

As described above, the application of the priming pulse PP causes charged particles generated by the predischarges caused by the pulses Pc1 and Pc2 and reduced over time to be restored in the discharge space. Thus, when a desired amount of charged particles exists on the dielectric layers in the discharge space, pixel data can be written by applying the scan pulse Pe.

For example, for a selective erasure, if the contents of pixel data indicate that an associated pixel cell is prohibited from emitting light, the pixel data pulse DP and the scan pulse Pe are simultaneously applied to this pixel cell, so that wall charges formed inside the pixel cell are extinguished, thus determining that the pixel cell will not emit light during the period (c). On the other hand, if the contents of pixel data indicate that an associated pixel cell is permitted to emit light, the scan pulse Pe only is applied to the pixel cell so that a discharge is not produced, whereby wall charges formed inside the pixel cell are sustained as they are, thus ensuring that the pixel cell will emit light in the period (c). Stated another way, the scan pulse Pe serves as a trigger for selectively erasing wall charges formed within pixel cells in accordance with pixel data.

On the other hand, for a selective write, a pixel data pulse at logical "1" and a scan pulse Pe are simultaneously supplied to increase the wall charges, thus determining that the pixel cell will emit light in the next period (c).

Next, in the period (c), the row electrode driving pulse generator circuit 120 continuously supplies the respective row electrodes X1–Xn with a series of sustain pulses Psx having a positive voltage and also continuously supplies the respective row electrodes Y1–Yn with a series of sustain pulses Psy having a positive polarity at timings staggered from the timings at which the sustain pulses Psx are applied, to continue a light emitting discharge for a display operation corresponding to pixel data which have been written during the period (b). In this event, in each cell which holds wall charges generated therein during the preceding period (b), the sustain pulse is applied thereto to cause a discharge through a discharge gap between its paired row electrodes by charge energy possessed by the wall charges per se and energy of the sustain pulse, allowing the cell to emit light. In a cell which has wall charges extinguished, since a potential difference Vs generated in the cell by the sustain pulse applied thereto is lower than the discharge start voltage, the cell will not discharge and accordingly will not emit light.

It should be noted that in the sustaining discharge process, the sustain pulse Psx1 first applied to the row electrode has a pulse width larger than those of the sustain pulses Psy1, Psx2, . . . applied at second and subsequent times.

The reason for the different pulse widths will be next described. Since the data write into pixel cells using pixel data and scan pulses is performed sequentially from the first to the n-th rows, a time taken to enter the sustaining discharge process after pixel data is written into pixel cells is different from one row to another. Specifically, over the entire panel, even in a situation, for example, in which the pixel data has determined that wall charges are maintained in pixel cells, the amounts of wall charges and space charges inside pixel cells immediately before entering the discharge sustaining period (c) may be different from one row to another. It is therefore possible that the sustaining discharge is not produced in a pixel cell in which the amount of wall charges has been reduced as the time has passed from the writing of pixel data to the sustaining discharge. To avoid such a situation, the first sustain pulse having a larger pulse width is employed such that a potential difference generated by the application of the first sustain pulse can remain active between the paired row electrodes for a period longer than usual so as to ensure that the first sustaining discharge is produced in either of pixel cells which have been selected to emit light for the display operation and to provide a uniform amount of charges in the pixel cells selected to emit light over the entire panel. The first sustaining discharge thus produced by the sustain pulse having a larger pulse width enables a uniform image to be displayed over the entire panel.

Next, in the period (d), as the row electrode driving pulse generator circuit 210 simultaneously applies an erasure pulse Pk to all the row electrodes Y1–Yn, the sustaining discharges in the respective cells are stopped to erase all pixel data which have been written into pixel cells during the period (b).

Thus, in a pixel cell, the reset pulse is applied between the paired row electrodes Xi, Yi for initialization to cause a reset discharge centered on the discharge gap G1 as a predischarge in the period (a). Next, in the period (b), pixel data are written into cells to select cells which emit light. In the period (c), a cell which has been selected to emit light based on the pixel data written thereinto in the period (c) is periodically applied with the sustain pulse to the paired row electrodes thereof to sustain a light emitting condition for display. In the period (d), the erasure pulse is applied to one row electrode of the paired row electrodes to erase the written data.

As described above, in the method of driving the plasma display panel according the present invention, all row electrodes are simultaneously supplied with the first predischarge pulse having a waveform which gently or gradually rises for initialization, the sustain pulse applied first to the row electrodes is provided with a wider pulse width in the sustaining discharge process, and the sustain pulse exhibiting gentle rising is applied, thereby driving the panel to emit light for display.

By thus providing the sustain pulse having a gently or gradually rising waveform, respective cells can discharge near their respective minimal discharge sustaining voltages, thus realizing stably micro-discharges. In addition, with the first predischarge pulse having a waveform which gradually rises, the luminance of light emitted from a pixel cell by a predischarge can be limited to a low level. Furthermore, since the first sustain pulse has a pulse width wider than that of the second and subsequent sustain pulses to ensure that the sustaining discharge occurs in pixel cells, the amounts of charges existing in respective pixel cells are substantially uniform for the same pixel data over the entire panel, thus making it possible to precisely emit light for display.

In the foregoing driving method, if a lower voltage or a shorter pulse width of the reset pulse results in an insufficient reset discharge in the initialization taking place during the period (a), a smaller amount of wall charges only is generated by such a reset discharge, wherein the wall charges mainly concentrate near the discharge gap.

In the subsequent period (b), when data indicative of a selective erasure is written, a selective discharge takes place in accordance with the data to extinguish wall charges existing near the discharge gap. In this event, since the wall charges to be erased only exist near the discharge gap and the amount of charges is small, the wall charges in a selected pixel cell can be substantially completely extinguished even if the pulse having a lower voltage or a narrower pulse width is applied for the selective discharge. In other words, it is possible to suppress the intensity of light emitted by a discharge which is not related to display.

In the subsequent period (c), even if the sustain pulse is applied, no discharge is produced in a pixel cell in which wall charges have been extinguished by the selective discharge, so that the pixel cell does not emit light. On the other hand, the application of the sustain pulse produces a discharge in a pixel cell in which no selective discharge has occurred and therefore wall charges still remain, causing the pixel cell to start light emission.

In addition, since the plasma display device of the present invention is of a surface discharge type, it is also necessary to take into consideration the distribution of wall charges near the electrodes. In an equilibrium state of a sustaining discharge, the amount of wall charges extensively distributes over entire regions around the row electrodes Xi, Yi on the dielectric layer. Thus, if the wall charges exist only near the discharge gap and its amount is less than the wall charges in the equilibrium state, the distribution of the wall charges gradually extends in a direction away from the discharge gap G1, i.e., toward the bus electrodes as the discharge is repeated. In this event, the intensity of light emitted from the pixel cell becomes gradually higher conforming to the amount of generated charges, and eventually reaches a fixed level.

Thus, since the pair of row electrodes Xi, Yi arranged on both sides of the discharge gap, through which the reset discharge, the selective discharge and the sustaining discharge occur, has a total length larger than the width of the bus electrode and an enlarged area, wall charges gradually spread in a direction away from the discharge gap by repeated sustaining discharges, and eventually spread over the entire row electrodes Xi, Yi to reach an equilibrium state. Thus, a sustaining discharge extensively occurs over the entire paired row electrodes Xi, Yi in the equilibrium state, and the pixel cell emits light which is ultraviolet rays emitted from a discharge region remaining in the equilibrium state. As a result, the entire row electrodes Xi, Yi appear to emit light in the pixel cell Pi,j, when viewed from the display plane side.

The number of pulses required to allow the wall charges to spread over the entire row electrodes, i.e., to bring the wall charges in the equilibrium state, during the period (c), is several times. Since the sustain pulse is applied approximately several tens to several hundreds of times in each sub-frame, the wall charges will substantially instantaneously reach the equilibrium state as the period (c) of the sub-frame is entered, wherein the entire row electrodes in each pixel cell appear to emit light when viewed from the display plane side. It will be appreciated from the foregoing that even an insufficient reset discharge will never affect the luminance of light emitted from pixel cells during display.

In the period (c) for applying sustain pulses alternately to one of the row electrodes Xi, Yi to sustain discharges for the light emitting pixels and the non-light emitting pixels, each of the sustain pulses has a rounded waveform exhibiting a change in magnitude of a voltage value which gradually increases from the vicinity of a minimal discharge sustaining voltage value in the unit light emitting region.

Figure 7A:
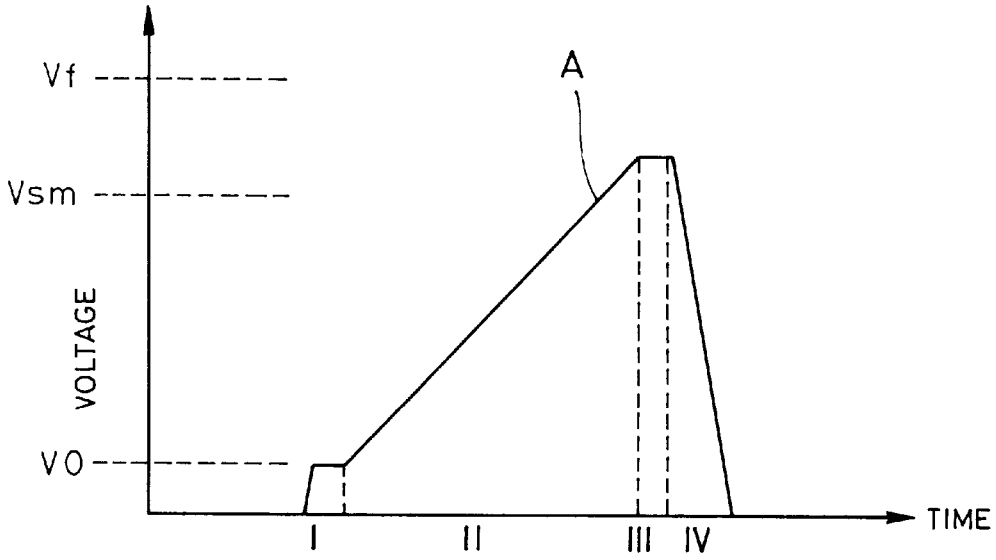
FIGS. 7A and 7B are diagrams illustrating a charging voltage waveform of a sustain pulse applied to row electrodes and a corresponding change in the luminance of light emitted from a cell in a method of driving a plasma display device according to an embodiment of the present invention.
Figure 7B:
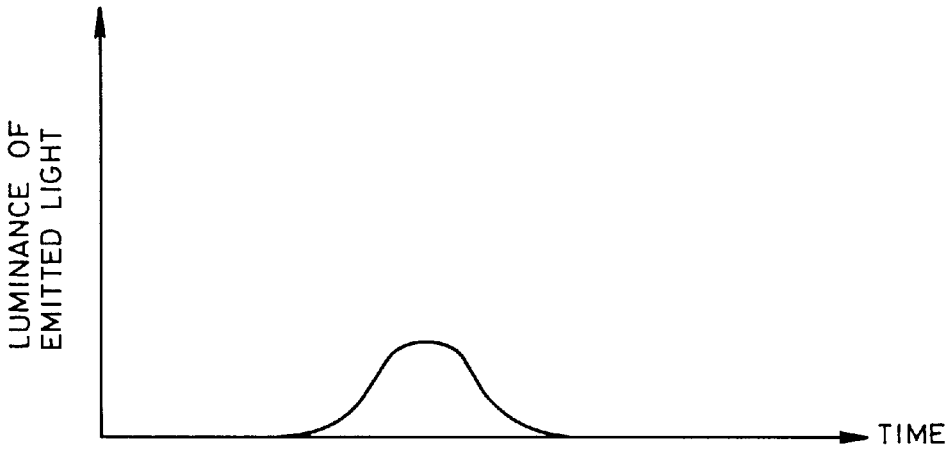

FIG. 7A illustrates an example of the rounded sustain pulse which exhibits gentle rising at a leading edge thereof in a method of driving a plasma display device according to an embodiment of the present invention. FIG. 7B illustrates a gently or gradually sloping output waveform of VUV emitted from a corresponding cell. In the method according to this embodiment of the present invention, a pulse exhibiting sufficiently gentle rising as illustrated in FIG. 7A, for example, a sinusoidal fly-back pulse is applied to row electrodes as a sustain pulse "A" to sustain a discharge in the middle of the rising voltage near a minimal discharge sustaining voltage "Vsm". More specifically, in a color plasma display panel using a discharge gas mixture composed of a Xe gas for generating VUV and a buffer gas having a higher ionization voltage than Xe, the particular method executes, during generation of each sustain pulse, a first process for starting a discharge with a voltage in the discharge space set at an initial voltage "V0" far the minimal discharge sustaining voltage "Vsm"; and a second process for gradually increasing an externally applied voltage for preventing the electric field in the discharge space from decreasing due to wall charges possibly formed after the discharge has been started, to sustain the discharge near the minimal discharge sustaining voltage "Vsm". It should be noted that if the externally applied voltage was continuously increased, this would cause even non-selected cells to discharge. Therefor the externally applied voltage is stopped from increasing at an appropriate voltage level to avoid the discharge of non-selected cells.

The sustain pulse "A" of this embodiment may be divided into a rising period I of the first process, a sustain start period II of the second process, a sustain complete period III, and a falling period IV.

A plasma display panel generally requires a limited time from application of a voltage to starting of a discharge. This discharge delay time is shorter as a larger voltage is applied. To promote the starting of a discharge, the rising period I is provided for once increasing the voltage to a proper level "V0".

In the sustain start period II, a gradually increasing voltage waveform is applied to induce a discharge at a low voltage near the minimal discharge sustaining voltage. The increasing rate may vary over time. During this period, a main discharge is started, and this discharge lasts for an appropriate time, with the amount of an increase in the externally applied voltage balanced with the amount of decrease in the voltage in the discharge space due to wall charges.

In the sustain complete period III, the voltage is stopped from increasing at a certain level since an excessively high voltage would cause cells, which are not intended to emit light, to also emit light.

In the falling period IV, the application of the voltage is terminated.

Figure 8:
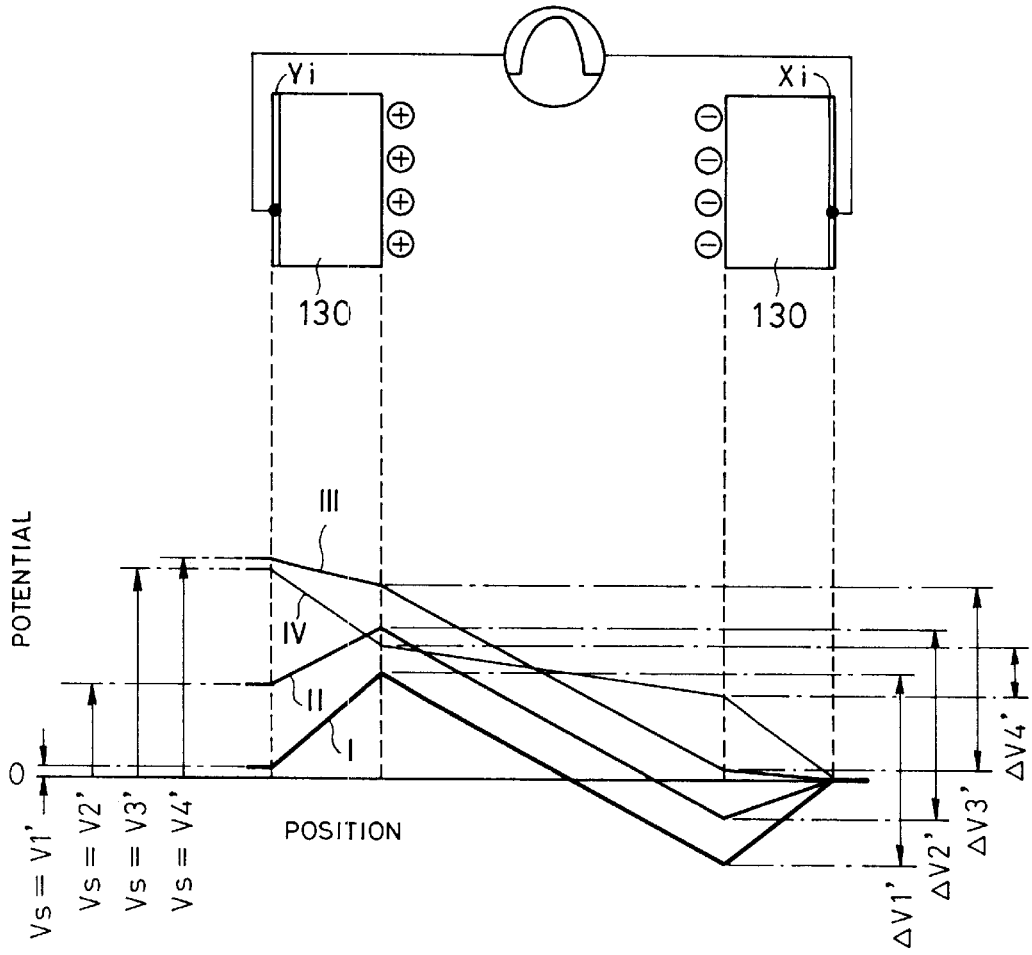
FIG. 8 is a graph illustrating a potential distribution between dielectric layers produced by wall charges formed on the dielectric layers in a cell of a plasma display panel when a rounded sustain pulse is applied in an embodiment according to the present invention.

Referring next to FIG. 8, the potential distribution between dielectric layers 130 affected by wall charges formed on the dielectric layers 130 from row electrodes Xi, Yi in a cell of a surface discharge AC plasma display panel exhibits a substantially constant gentle gradient over time in the order of the rising period I, the sustain start period II, the sustain complete period III and the falling period IV illustrated in FIG. 7A. Assuming that voltages applied in the rising period I, the sustain start period II, the sustain complete period III and the falling period IV are V1', V2', V3' and V4' respectively, these voltages are set to satisfy $V1'<V2'<V3'\approx V4'$ in this embodiment. During the periods I to IV, a change in the potential difference due to the wall charges is expressed by $\Delta V1'\approx\Delta V2'\approx\Delta V3'>\Delta V4'$. In this case the potential difference between the wall charges over row electrodes Xi, Yi changes gently or substantially constant without rapid decreasing thereof. In the rising period I, the sustain start period II and the sustain complete period III in the sustain pulse according to this embodiment illustrated in FIGS. 7A and 8, a flowing discharge current corresponds to the applied voltage near the minimal discharge sustaining voltage, so that the field strength will not become high enough to cause excitation and ionization of the buffer gas.

The minimal discharge sustaining voltage at which a discharge is started depends on parameters such as a particular cell structure, the rising rate of the applied voltage, a discharge frequency and so on. It is desirable that for the initial voltage "V0" for starting a discharge, conditions for the voltage waveform is selected such that the initial voltage "V0" falls within the following range:

$$Vsm-1.0\times(Vf-Vsm)\leqq V0\leqq Vsm+0.2\times(Vf-Vsm)$$

where "Vsm" represents the minimal discharge sustaining voltage in a normal rectangular pulse, and "Vf" represents a discharge start voltage. The voltage V0, at which a discharge is started, is generated, for example, when a discharge current begins to flow at about 10% of its peak value.

Figure 9A:
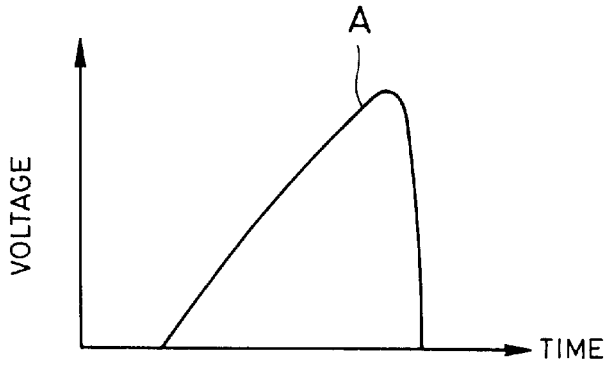
FIGS. 9A to 9C are diagrams illustrating charging voltage waveforms of various sustain pulses applied to row electrodes in a method of driving a plasma display device according to another embodiment of the present invention.
Figure 9B:
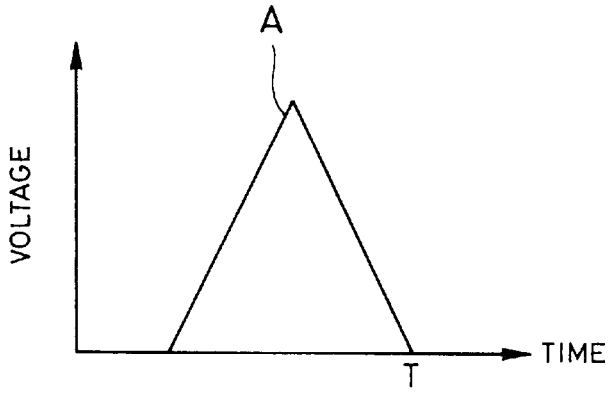
Figure 9C:
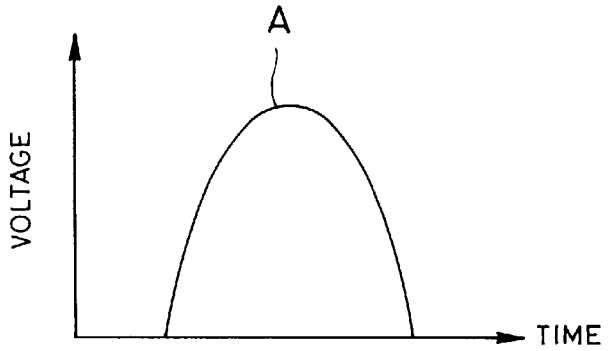

A desired voltage, voltage rising rate and so on depend on the type of buffer gas, a gas pressure, the structure of discharge cells, and so on. There are also additional factors which may affect them. For example, a discharge delay time is shorter in a surface discharge than in an opposing discharge, an increase in Xe concentration or gas pressure results in a higher discharge voltage, and so on. It is however preferable that, as a criterion, the voltage V0, at which a discharge is started, falls within the range defined by the foregoing expression in terms of the minimal discharge sustaining voltage "Vsm" in a normal rectangular pulse and the discharge start voltage "Vf". It should be noted that the waveform illustrated in FIG. 7A is a mere example, and may omit the periods I and III. Also, a saw-tooth wave (FIG. 9A), a triangular wave (FIG. 9B) and a sinusoidal wave (FIG. 9C) may be used alternatively as the sustain pulse "A" which exhibits sufficiently gentle rising illustrated in FIG. 7.

Figure 10A:
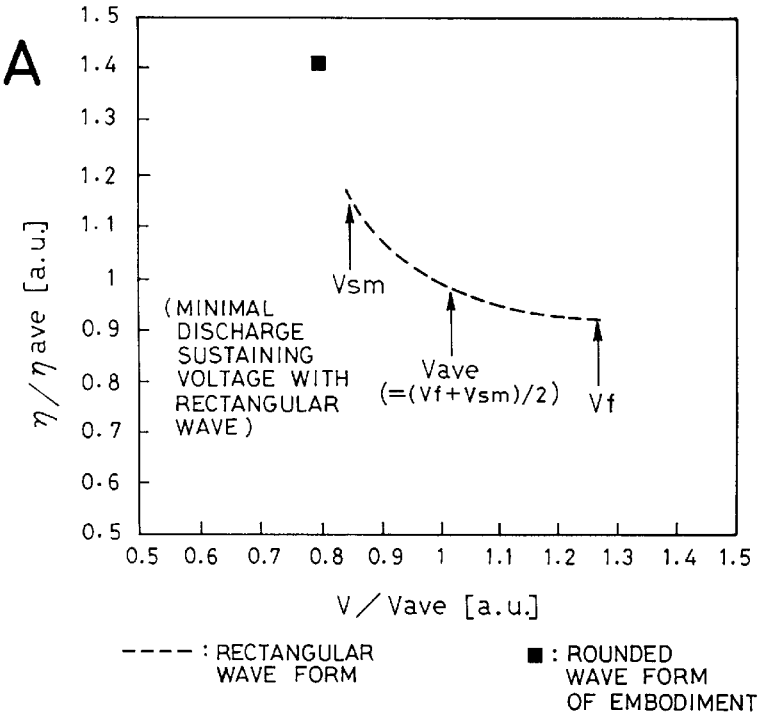
FIGS. 10A and 10B are graphs illustrating the sustain voltage versus light emitting efficiency characteristics and the luminance versus light emitting efficiency characteristics of a surface discharge AC plasma display device according to an embodiment of the present invention and a comparative example.
Figure 10B:
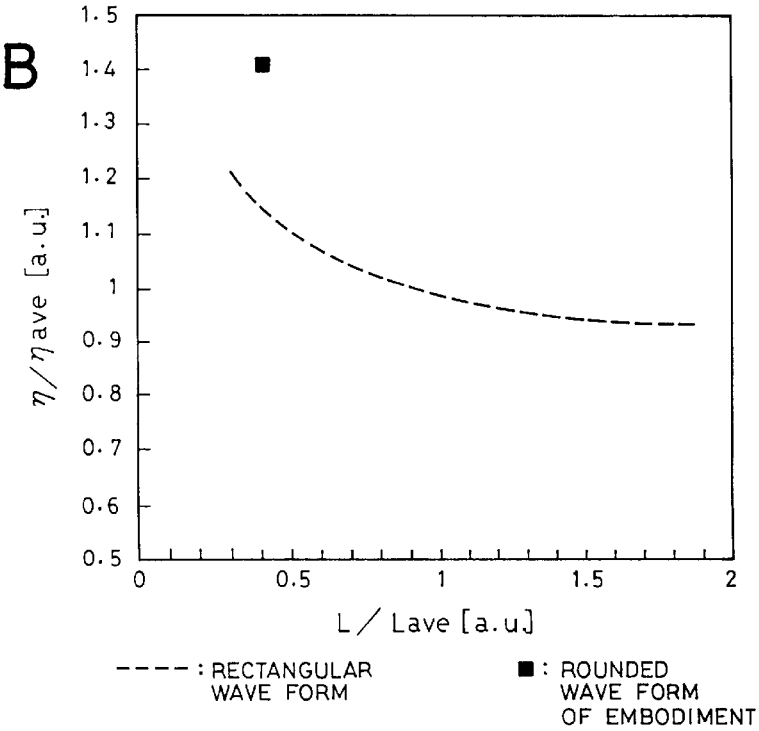

As an example, the light emitting efficiency was measured using a surface discharge AC plasma display panel which is filled with a Ne-5%Xe gas at a pressure of 500 Torr, when it was applied with a sustain pulse having a gradient of approximately 50 V/microsecond of this embodiment and when it was applied with a conventional rectangular sustain pulse as a comparative example. FIG. 10A illustrates the sustain voltage versus the light emitting efficiency characteristics, and FIG. 10B illustrates the luminance versus the light emitting efficiency characteristics. As is apparent from FIG. 10A, the sustain pulse of this embodiment provides the light emitting efficiency 1.5 times higher than that of the conventional rectangular pulse in terms of the sustain voltage versus the light emitting efficiency characteristics. Likewise, as is apparent from FIG. 10B, the sustain pulse of this embodiment provides the luminance 1.3 times higher (at the same driving frequency) as compared with the luminance provided by low voltage driving with the rectangular pulse. Therefore, the increasing rate of the voltage, when gradually increasing from a value near the minimal discharge sustaining voltage, is preferably 50 volts or lower per microsecond.

Since the driving method of this embodiment applies a lower voltage to the discharge space, a dielectric protection layer or the like is less damaged by discharges, resulting in a longer life time of the panel. In addition, since an instantaneous discharge current is reduced, the bus electrodes need not have a limited resistance value, and accordingly can have a reduced width, thus resulting in an increased aperture ratio and an improved light emitting efficiency.

Since the driving method according to this embodiment only requires that the voltage applied to the discharge space satisfies the aforementioned condition, the sustain electrodes, the address electrodes and so on may be applied with any voltages having any waveforms. For example, with a surface discharge AC plasma display panel, X-row sustain electrodes may be applied with a plus pulse, and Y-row sustain electrodes may be applied with a minus pulse at appropriate timing. Also, while this embodiment has been described for a surface discharge AC plasma display panel, the present invention is not limited to this particular type of plasma display panel. It goes without saying that the present invention may be applied to any color plasma display panels of opposing discharge type, thin surface discharge type, and so on, irrespective of the structure.

What is claimed is:

1. A method of driving a plasma display device displaying an image, said plasma display device including a plurality of row electrodes formed in pairs and extending in parallel with each other in the horizontal direction, a plurality of column electrodes extending in the vertical direction and facing said paired row electrodes with a discharge space intervening therebetween to form unit light emitting regions at respective intersections with said paired row electrodes, and a dielectric layer for covering up said paired row electrodes with respect to said discharge space, said discharge space being filled with a gas mixture including Xenon at a predetermined pressure, said method comprising the steps of:

applying a scan pulse to every pair of row electrodes and simultaneously applying a pixel data pulse to every column electrode to select light emitting pixels and non-light emitting pixels during an addressing period; and applying a series of sustain pulses alternately to one of the row electrode pair and the other thereof to sustain discharges for said light emitting pixels and said non-light emitting pixels during a discharge sustaining period, wherein every one of said sustain pulses has a waveform exhibiting a change in magnitude of a voltage value which gradually increases at a leading edge thereof.

2. A method of driving a plasma display device according to claim 1, wherein every one of said sustain pulses has a change rate in the voltage value of 50 volts or less per microsecond at the leading edge.

3. A method of driving a plasma display device according to claim 1, wherein said change in the voltage value of every one of said sustain pulses at the leading edge is gentle as compared with a change in a voltage value rising or falling at a leading edge of said scan pulse.

4. A method of driving a plasma display device according to claim 1, wherein said method executes, during generation of every one of said sustain pulses, a first process for starting a discharge with a voltage in the discharge space set at an initial voltage lower than a minimal discharge sustaining voltage; and a second process for gradually increasing an externally applied voltage for preventing an electric field in the discharge space from decreasing due to wall charges possibly formed after the discharge has been started.

5. A method of driving a plasma display device according to claim 4, wherein said initial voltage "VO" is set within a following range:

$$Vsm-1.0\times(Vf-Vsm)\leqq VO\leqq Vsm+0.2\times(Vf-Vsm)$$

where "Vsm" represents the minimal discharge sustaining voltage in a normal rectangular pulse, and "Vf" represents a discharge start voltage.

6. A method of driving a plasma display device according to claim 1, wherein every one of said sustain pulses has a shape selected from a group composed of pulse waveforms having a saw-tooth wave, a triangular wave and a sinusoidal wave.

* * * * *